US007682293B2

(12) United States Patent
Eschenbach

(10) Patent No.: US 7,682,293 B2
(45) Date of Patent: Mar. 23, 2010

(54) LATERAL ELLIPTICAL EXERCISE APPARATUS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 367 days.

(21) Appl. No.: 11/713,064

(22) Filed: Mar. 2, 2007

(65) Prior Publication Data

US 2008/0214362 A1 Sep. 4, 2008

(51) Int. Cl.
*A63B 22/12* (2006.01)

(52) U.S. Cl. ..... 482/62; 482/51; 482/52

(58) Field of Classification Search ..... 482/51, 482/52, 53, 57, 62, 70, 71, 114, 115, 120, 482/148

See application file for complete search history.

(56) References Cited

U.S. PATENT DOCUMENTS

| | | | | |
|---|---|---|---|---|
| 5,518,470 A | | 5/1996 | Piaget et al. | 482/51 |
| 5,536,225 A | | 7/1996 | Neuberg et al. | 482/71 |
| 5,575,739 A | | 11/1996 | Piaget et al. | 482/51 |
| 5,595,554 A | * | 1/1997 | Maresh | 482/52 |
| 6,042,512 A | * | 3/2000 | Eschenbach | 482/52 |
| 6,045,488 A | * | 4/2000 | Eschenbach | 482/52 |
| 6,206,806 B1 | | 3/2001 | Chu | 482/53 |
| 6,551,218 B2 | | 4/2003 | Goh | 482/52 |
| 6,641,506 B1 | * | 11/2003 | Yang | 482/52 |
| 6,679,813 B1 | | 1/2004 | Gray | 482/71 |
| 6,830,538 B2 | * | 12/2004 | Eschenbach | 482/52 |
| 7,052,439 B2 | | 5/2006 | Anderson et al. | 482/52 |
| 7,108,638 B2 | * | 9/2006 | Snyderman | 482/57 |
| 7,153,238 B2 | | 12/2006 | Anderson et al. | 482/52 |
| 2005/0209058 A1 | | 9/2005 | Yu | 482/52 |
| 2006/0046902 A1 | | 3/2006 | Chang | 482/52 |
| 2006/0264301 A1 | | 11/2006 | Kuo | 482/52 |
| 2006/0281604 A1 | | 12/2006 | Stewart et al. | 482/51 |
| 2008/0020902 A1 | * | 1/2008 | Arnold | 482/51 |

* cited by examiner

*Primary Examiner*—Nicholas D Lucchesi
*Assistant Examiner*—Tam Nguyen

(57) ABSTRACT

The present invention relates to a standup exercise apparatus that simulates lateral climbing with arm exercise. More particularly, the present invention relates to an exercise machine having separately supported pedals for the feet and arm exercise coordinated with the motion of the feet. Each pedal follows a separate elongate curve with lateral movement. As one pedal moves downward on the inside portion of one pedal curve, the other pedal moves sideways upward following the outer portion of the other pedal curve. A pair of cranks rotate in opposite directions when driven by the pedal movement. The orientation of the pedal curves is adjustable to exercise leg muscles differently. Arm exercise is coordinated with the foot pedal movements.

17 Claims, 5 Drawing Sheets

LATERAL ELLIPTICAL EXERCISE APPARATUS

BACKGROUND OF THE INVENTION

1. Field

The present invention relates to a standup exercise apparatus that simulates lateral climbing with arm exercise. More particularly, the present invention relates to an exercise machine having separately supported pedals for the feet and arm exercise coordinated with the sideways motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve moving forward and rearward of an operator to simulate the motions of jogging and slight climbing. There is a need for an elliptical exercise machine capable of lateral or sideways climbing foot movements.

Recently, the art has seen some elliptical motions with front to rear climbing movements such as Chu in U.S. Pat. No. 6,206,806, Goh in U.S. Pat. No. 6,551,218 and Stewart et al. in U.S. Pat. Application No. 2006/0281604. Other climbing apparatus having front to rear foot motions appear in Anderson et al. U.S. Pat. Nos. 7,052,439 and 7,153,238 and Kuo in U.S. Pat. Application No. 2006/0264301. The teeter-totter category addresses side to side lateral foot movements in Piaget et al. U.S. Pat. Nos. 5,518,470 and 5,575,739, Yu in U.S. Pat. Application No. 2005/0209058, Yang in U.S. Pat. No. 6,641,506 and Gray in U.S. Pat. No. 6,679,813. Some sideways foot movement is added to the elliptical apparatus shown by Chang in U.S. Pat. Application No. 2006/0046902.

There is a need for a pedal operated exercise machine that can be safely operated in the standup position whereby the arms and legs can be exercised with the feet moving through a generally lateral elliptical movement. There is also a need to adjust the orientation of the lateral elliptical pedal curve to exercise the leg muscles differently during lateral climbing.

It is one objective of this invention to provide lateral elliptical pedal movement with a path generating linkage coordinated with arm exercise. Another object of this invention is to provide an adjustable pedal motion.

SUMMARY OF THE INVENTION

The present invention relates to the kinematic motion control of pedals which simulate lateral climbing during several modes of operation. More particularly, apparatus is provided that offers variable intensity exercise through a leg operated cyclic motion in which the pedal supporting each foot is guided through successive sideways positions during the motion cycle while a load resistance acts upon the mechanism.

The pedals are guided through a vertically elongated curve motion while the sideways pedal angles vary during the pedal cycle to add some ankle exercise. Arm exercise is by arm levers coordinated with the mechanism guiding the foot pedals.

In the preferred embodiment, the apparatus includes a separate pedal for each foot, each pedal being supported by a foot support which is pivotally connected to a crank and a guide. The cranks are connected by a coupling device such as a gear pair which rotate in opposite directions with the cranks. The guides are rocker links pivotally connected to the foot supports and the framework using rocker link brackets. The rocker link brackets can be relocated manually or by actuator to change the pedal motion.

Arm exercise is provided with handles pivotally connected to the framework and coordinated with the foot supports. When the foot is up, the handle corresponding to that foot is generally up.

Load resistance is imposed upon the crank arms through pulleys and belts from a flywheel and frictional resistance. A control system regulates the load on the flywheel to vary the resistance to exercise. The resistance can be varied during operation through a control system within easy reach of the operator. Other forms of load resistance such as an alternator, magnetic, air, fluid, etc. may also be used.

Movement of the pedals cause the pedals to follow a vertically elongated path similar to an ellipse where the longer major axis of the ellipse is generally inclined to provide the lateral climbing motion. The shorter minor axis of the ellipse provides the sideways foot motion.

An alternate embodiment is shown using adjustable tracks as guides for the foot support. An actuator and control system adjusts the incline of the tracks to exercise leg muscles differently.

In summary, this invention provides the operator with stable foot pedal support having motions that simulate lateral climbing with very low joint impact and upper body exercise. The pedal motion exhibits vertically oriented elliptical lateral foot motion.

DETAILED DESCRIPTION OF THE EMBODIMENTS

Figure 1:
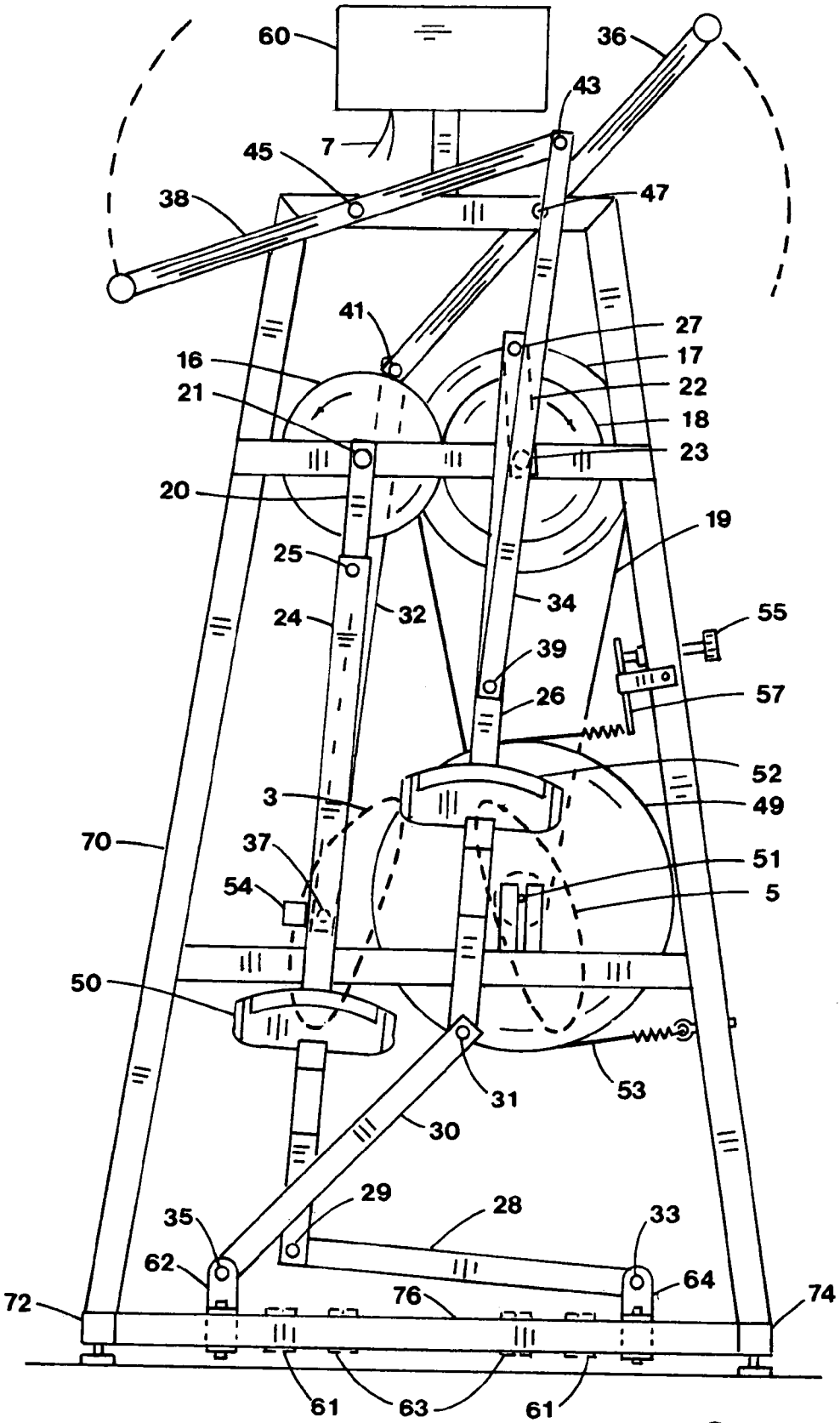
FIG. 1 is a frontal view of the preferred embodiment of an exercise machine constructed in accordance with the present invention.
Figure 2:
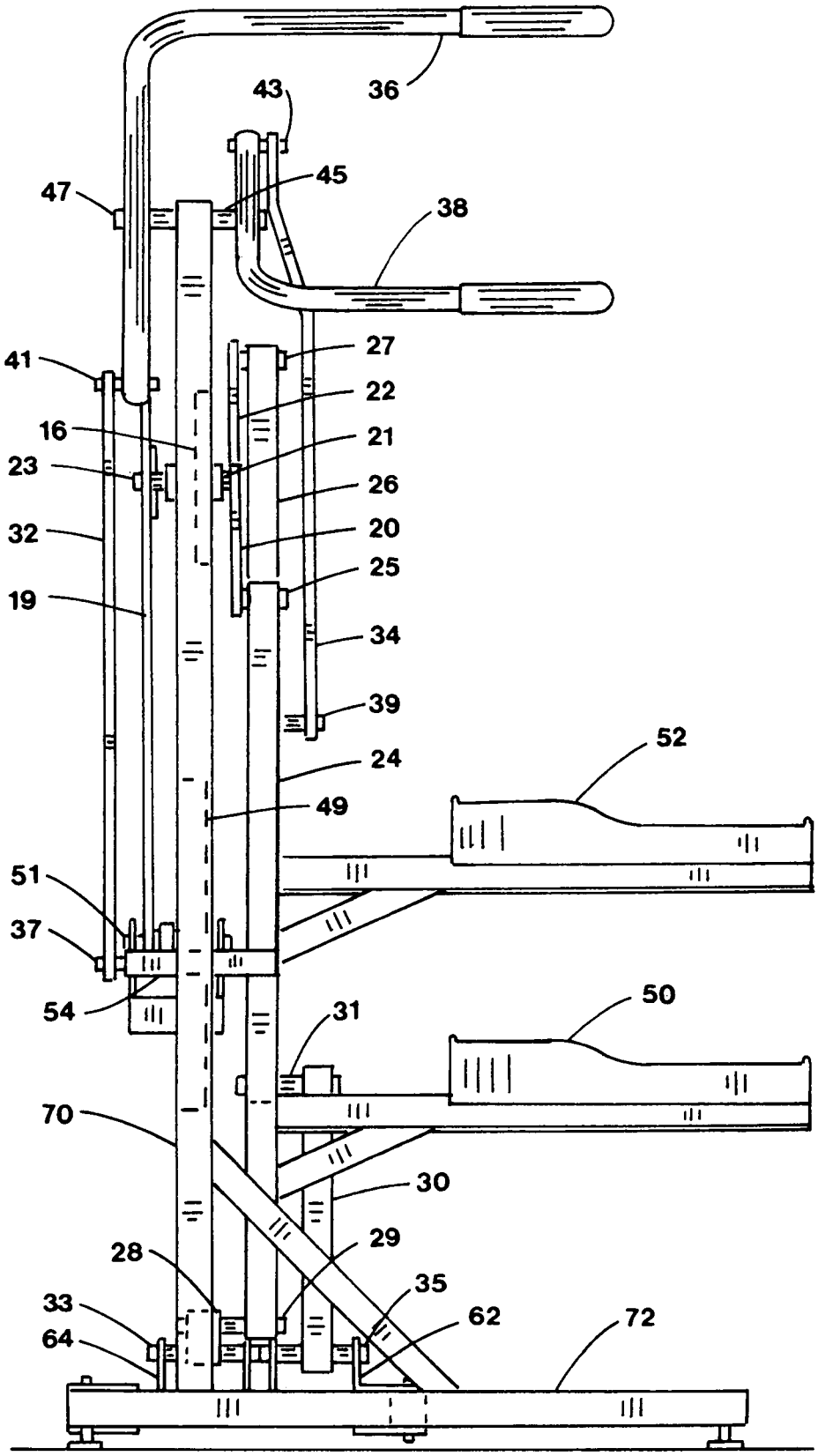
FIG. 2 is the side view of the preferred embodiment shown in FIG. 1.

Referring to the drawings in detail, pedals 50 and 52 are shown in FIGS. 1 and 2 in the lowermost and uppermost positions of the first embodiment. Pedals 50 and 52 are supported by foot supports 24 and 26 and traverse vertically elongated closed loop paths 3 and 5. Cranks 20,22 rotate about pivot axis 21,23 and are pivotally connected to foot supports 24,26 at pivots 25,27. Meshed gears 16 and 18 rotate about pivot axis 21,23 and with cranks 20,22 causing them to rotate in opposite directions.

Rocker links 28,30 are connected to foot supports 24,26 at pivots 29,31 and to adjustment brackets 62,64 at pivots 33,35. Body weight causes pedal 52 to lower on the inside portion of vertically elongated curve 5 while pedal 50 rises on the outer portion of vertically elongated curve 3 with lateral motion. When pedal 50 begins the downward descent along the inner portion of curve 3, pedal 52 rises along the outer portion of curve 5 with lateral elliptical foot motion.

Pulley 17 rotates with crank 22 about pivot axis 23. Belt 19 is engaged with pulley 17 and drives flywheel 49 about pivot axis 51. Friction belt 53 wraps flywheel 49 to provide load resistance which is adjustable using knob 55 and lever 57. As an alternate, an actuator 91 as shown in FIG. 3 can regulate the load resistance as part of control system 60 through wires 7.

Arm exercise is provided along side the operator by handles 36,38 which rotate about pivots 47,45. Connecting links 32,34 are pivotally connected to handles 36,38 at pivots 41,43 and to foot supports 24,26 at pivots 37,39. Foot support extension 54 locates connecting link 32 at the rear of the exercise apparatus.

Framework 70 supports pivot axis 21,23, handle pivots 45,47, flywheel pivot 51 and adjustment lever 57. Framework 70 connects to horizontal frame members 72,74 which are configured to rest on a horizontal surface. Frame member 76 connects frame members 72 and 74 and supports rocker pivot adjustment brackets 62,64. By relocating rocker link adjustment brackets 62,64 to alternate positions 61 or 63, the orientation of pedal curves 3,5 can be changed for different exercise. The relocation of brackets 62,64 can be manual or by actuator 91 as shown in FIG. 3 with control system 60.

Figure 3:
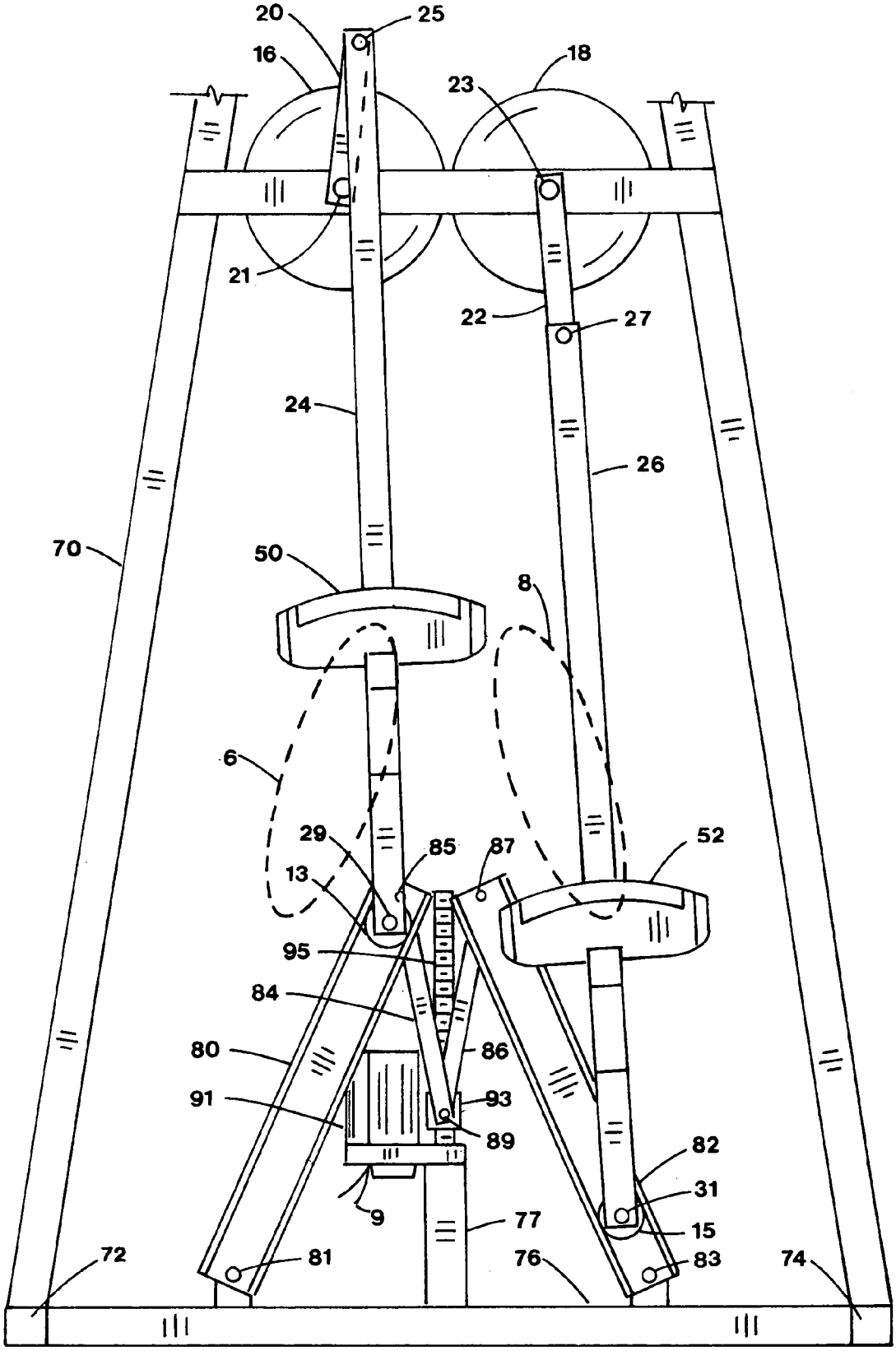
FIG. 3 is a frontal view of an alternate embodiment using guide tracks adjusted close together.
Figure 4:
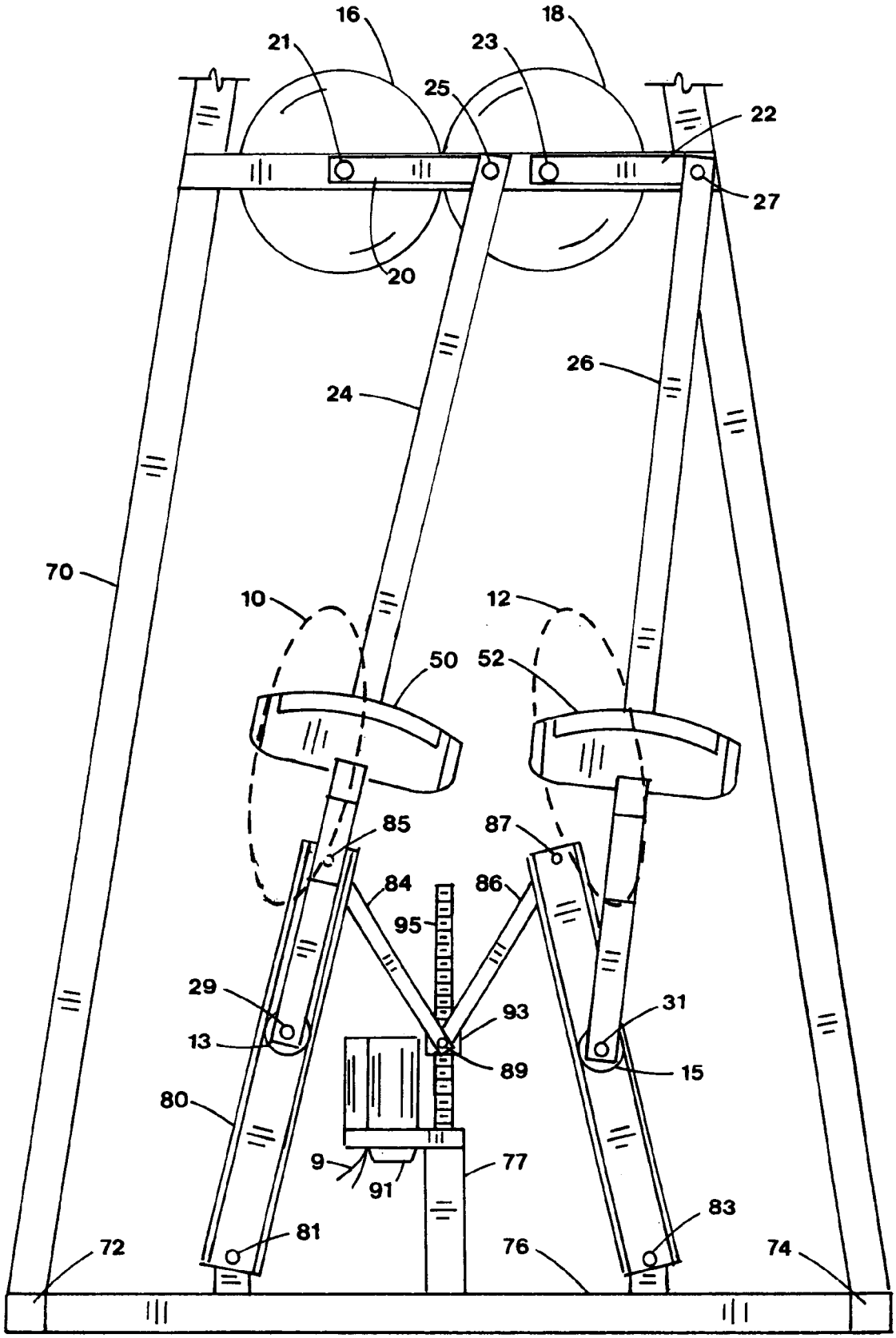
FIG. 4 is a frontal view of the alternate embodiment of FIG. 3 with the guide tracks adjusted farther apart.
Figure 5:
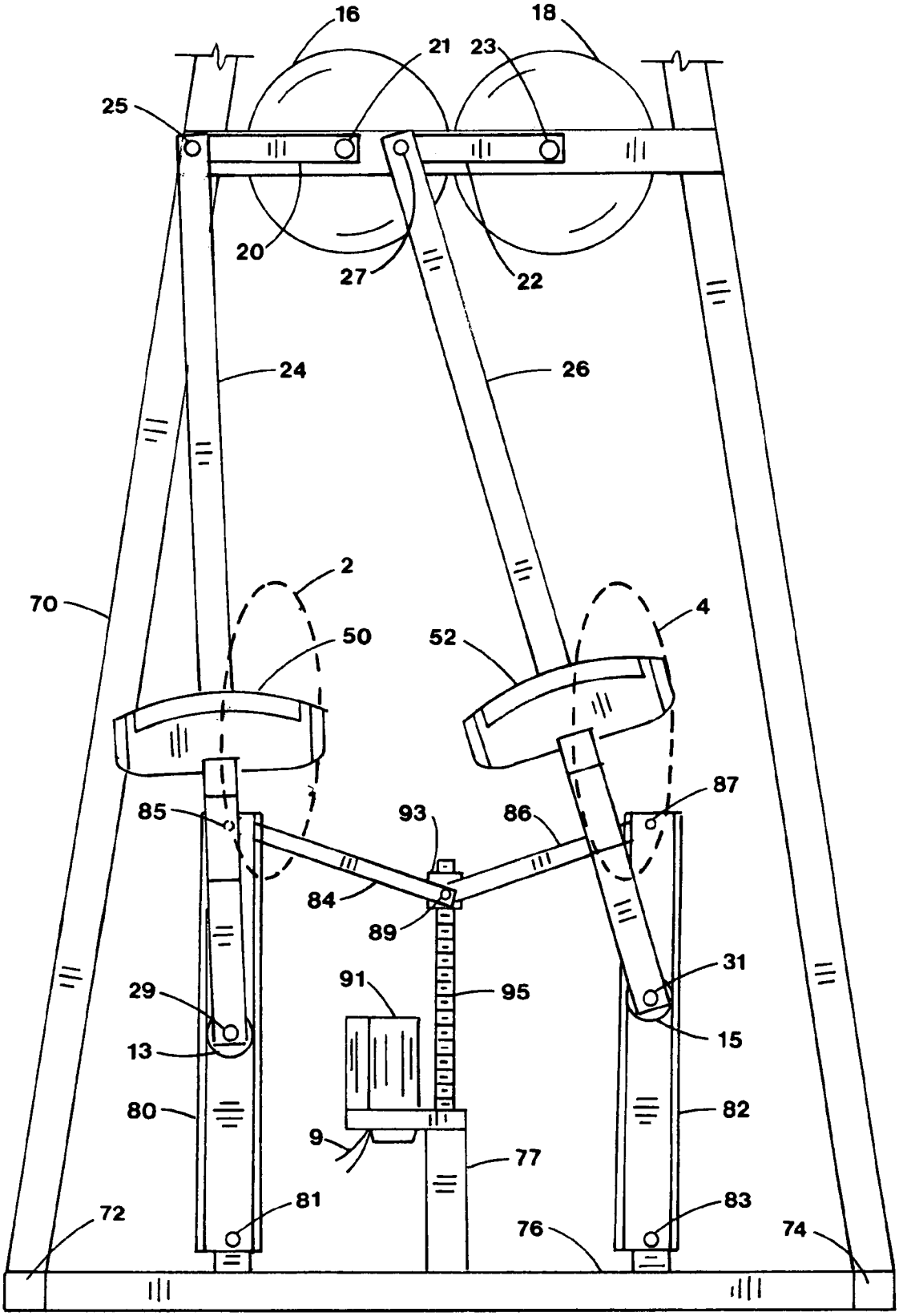
FIG. 5 is a frontal view of the alternate embodiment of FIG. 3 with the guide tracks adjusted to a vertical position.

An alternate embodiment is shown in FIGS. 3,4 and 5 where the rocker link guides 28,30 have been replaced with guide tracks 80,82. Rollers 13,15 rotate about pivots 29,31 and are in rollable contact with guide tracks 80,82. Guide tracks 80,82 are connected to frame member 76 at pivots 81,83. Actuator 91 is supported by bracket 77 which connects to frame member 76. Adjustment links 84,86 are connected to guide tracks 80,82 at pivots 85,87 and to actuator screw nut 93 at pivots 89. Actuator screw nut 93 can move along actuator screw 95 as directed by control system 60 through wires 7,9 by conventional means. The rest of the alternate embodiment is the same as the preferred embodiment of FIGS. 1 and 2 with the arm exercise handles 36,38 and flywheel 49 not shown for clarity.

FIG. 3 shows the upper portion of guide tracks 80,82 close together causing pedals 50,52 to follow inclined pedal curves 6,8. FIG. 4 shows guide tracks 80,82 adjusted further apart such that pedals 50,52 follow pedal curves 10,12. FIG. 5 shows guide tracks 80,82 adjusted to be vertical resulting in pedals 50,52 following the vertical elliptical pedal curves 2 and 4 with lateral movement.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising:

a framework, said framework configured to be supported by a horizontal surface;

a pair of crank arms, each said crank arm rotatably connected to said framework at a respective pivot axis and configured to rotate through continuous full revolutions during operation of said exercise apparatus;

a coupling device, said coupling device configured to cause said crank arms to have operably associated opposing rotation;

a pair of foot supports, each said foot support pivotally connected to a respective said crank arm pivotally connected to one end and having a foot engaging pedal connected to the other end of said foot support to follow a closed loop elongate curve positioned lateral to an operator having a major axis oriented generally vertical;

a pair of guides, each said guide operably associated with a respective said foot support and said framework to cause a portion of said foot support to have a generally up and down movement;

said pedals configured to move relative to said framework when the feet of said operator are rotating said crank arms whereby said pedals follow said closed loop elongate curves with movement that is lateral to said operator.

2. The exercise apparatus according to claim 1 further comprising an arm exercise device, said arm exercise device operably associated with said foot supports.

3. The exercise apparatus according to claim 2 wherein said arm exercise device comprises a pair of handles, each said handle operably associated with a corresponding said foot support.

4. The exercise apparatus according to claim 1 further comprising a flywheel, said flywheel rotatably connected to said framework and operably associated with said crank arms to rotate with continuous rotation.

5. The exercise apparatus according to claim 4 further comprising a load resistance, said load resistance operably associated with said flywheel, a means for adjustment of said load resistance and, a control system, said control system positioned within reach of the operator whereby said load resistance can be varied during operation of said exercise machine.

6. The exercise apparatus according to claim 1 wherein said coupling device is a pair of meshed gears, each said gear attached to a respective said crank arm to rotate about said pivot axis whereby one said crank arm rotates opposite to the other said crank arm.

7. The exercise apparatus according to claim 1 wherein said guides are operably associated with an adjustment device, said adjustment device configured to change the orientation of said closed loop elongate curves for said pedals.

8. The exercise apparatus according to claim 7 wherein said adjustment device is an actuator, said actuator operably associated with said guides to move said guides in a vertical plane about separate nonaligned pivots and a control system such that said control system can change the position of said guides during operation of said exercise apparatus.

9. The exercise apparatus according to claim 1 wherein said guide comprises a roller and track, said roller pivotally connected to said foot support and in rollable contact with said track, said track connected to said framework.

10. An exercise apparatus comprising:

a framework, said framework configured to be supported by a horizontal surface;

a pair of crank arms, each said crank arm rotatably connected to said framework at a respective pivot axis and configured to rotate through continuous full rotations during operation of said exercise apparatus;

a pair of meshed gears, each said gear attached to a respective said crank arm to rotate about a respective said pivot axis on said framework in a direction opposed to the direction of rotation of the other said crank arm;

a pair of foot supports, each said foot support pivotally connected to a respective said crank arm;

a pair of pedals, each pedal attached to a respective foot support and following a separate closed loop elongate curve positioned lateral to an operator;

a pair of guides, each said guide operably associated with a respective said foot support and said framework;

said pedals configured to move relative to said framework when the feet of said operator are rotating said crank arms whereby one said pedal follows one said closed loop elongate curve moving downward while the other said pedal is moving sideways upward along the other said closed loop elongate curve.

11. The exercise apparatus according to claim 10 further comprising an arm exercise device, said arm exercise device operably associated with said foot support.

12. The exercise apparatus according to claim 10 wherein said guides are operably associated with an adjustment device, said adjustment device configured to change the orientation of said closed loop elongate curves for said pedals.

13. The exercise apparatus according to claim 10 wherein said guide comprises a roller and track, said roller pivotally connected to said foot support and in rollable contact with said track, said track connected to said framework.

14. An exercise apparatus comprising:

a framework, said framework configured to be supported by a horizontal surface;

a pair of crank arms, each said crank arm rotatably connected to said framework at a respective pivot axis and configured to rotate through continuous full rotations during operation of said exercise apparatus;

a coupling device, said coupling device configured to cause said crank arms to have operably associated opposing rotation;

a pair of foot supports, each said foot support pivotally connected to a respective said crank arm and having a foot engaging pedal configured to follow a closed loop elongate curve positioned lateral to an operator;

a pair of guides, each said guide operably associated with a respective said foot support and said framework to cause a portion of said foot support to have a generally up and down movement;

an adjustment device, said adjustment device operably associated with said guides and said framework;

said pedals configured to move relative to said framework when the feet of said operator are rotating said crank arms whereby said pedals follow said closed loop elongate curves with movement that is sideways to said operator and said adjustment device can change the orientation of said closed loop elongate curves.

15. The exercise apparatus according to claim 14 further comprising a control system, said control system operably associated with said adjustment device and positioned within reach of the operator whereby the position of said guides can be varied during operation of said exercise machine.

16. The exercise apparatus according to claim 14 further comprising an arm exercise device, said arm exercise device operably associated with said foot supports.

17. The exercise apparatus according to claim 14 wherein said coupling device is a pair of meshed gears, each gear attached to a respective said crank arm to rotate about a respective said pivot axis whereby one said crank arms rotates opposite to the other said crank arm.

* * * * *